US009470453B2

(12) United States Patent
Ling

(10) Patent No.: US 9,470,453 B2
(45) **Date of Patent: *Oct. 18, 2016**

(54) CONTROLLED NUCLEATION DURING FREEZING STEP OF FREEZE DRYING CYCLE USING PRESSURE DIFFERENTIAL WATER VAPOR $CO_2$ ICE CRYSTALS

(71) Applicant: Millrock Technology, Inc., Kingston, NY (US)

(72) Inventor: Weijia Ling, Bethlehem, PA (US)

(73) Assignee: Millrock Technology, Inc., Kingston, NY (US)

( * ) Notice: Subject to any disclaimer, the term of this patent is extended or adjusted under 35 U.S.C. 154(b) by 420 days.

This patent is subject to a terminal disclaimer.

(21) Appl. No.: 13/960,018

(22) Filed: Aug. 6, 2013

(65) Prior Publication Data

US 2015/0040420 A1 Feb. 12, 2015

(51) Int. Cl.
*F26B 5/06* (2006.01)

(52) U.S. Cl.
CPC ..... *F26B 5/06* (2013.01)

(58) Field of Classification Search
CPC ..... F26B 5/06
See application file for complete search history.

(56) References Cited

U.S. PATENT DOCUMENTS 8,839,528 B2 * 9/2014 Ling ..... F26B 5/06 34/298
8,875,413 B2 * 11/2014 Ling ..... F26B 5/06 34/298

* cited by examiner

*Primary Examiner* — Jiping Lu
(74) *Attorney, Agent, or Firm* — Nixon & Vanderhye, P.C.

(57) ABSTRACT

A method of controlling and enhancing the nucleation of product in a freeze dryer wherein a product is maintained at a predetermined temperature and pressure. A mixture of water vapor and $CO_2$ gas is introduced into a condenser chamber separate from the product chamber to create a predetermined volume of condensed frost, ice and dry ice crystals on an inner surface of the condenser chamber. The condenser chamber is connected to the product chamber and has a predetermined pressure that is greater than that of the product chamber. Upon the opening of the condenser chamber into the product chamber, gas turbulence is created that causes the condensed frost in the form of an ice fog and accompanying ice and dry ice crystals to rapidly enter the product chamber for even distribution therein to create uniform and rapid nucleation of the product in different areas of the product chamber.

5 Claims, 2 Drawing Sheets

CONTROLLED NUCLEATION DURING FREEZING STEP OF FREEZE DRYING CYCLE USING PRESSURE DIFFERENTIAL WATER VAPOR $CO_2$ ICE CRYSTALS

BACKGROUND OF THE INVENTION

1. Field of the Invention

The present invention relates to a method of controlling nucleation during the freezing step of a freeze drying cycle and, more particularly, to such a method that uses a pressure differential water vapor and $CO_2$ ice fog and ice crystal distribution to trigger a spontaneous nucleation among all vials in a freeze drying apparatus and to minimize melting of ice crystals during flow from the condenser chamber to the product to be freeze dried.

2. Description of the Background Art

As described in my copending application Ser. No. 13/097,219, filed on Apr. 29, 2011, the new and improved controlled ice nucleation method utilizes the pressure differential between the seeding chamber (condensing chamber) and product chamber in a freeze dryer to instantly distribute the ice nucleation seeding crystals across the whole batch of product. Seeding ice crystals are originally generated inside a cold condensing chamber typically with a condensing surface below −80° C. Initially ice crystals exist in forms of frost on the condensing surface and frozen fog in suspension.

Once triggered by pressure differential distribution, frost breaks loose from the condensing surface mixing with frozen fog in suspension and rushes into the product chamber to trigger ice nucleation. During this travel between the seeding chamber and the product chamber, seeding flow has direct contact with surfaces at temperatures above 0° C. such as a vapor duct, isolation valve, baffle plate, product chamber wall, shelf stack parts and other surfaces. Depending on the complexity of the flow path, part of the seeding ice crystals melt before reaching the product surfaces.

This effect has great impact on ice nucleation efficiency in systems that have long or complex flow paths with obstacles at temperatures above 0° C. Some previous methods have compensated for the loss of seeding crystals by generating excessive amounts of seeding crystals and extended pre-cooling of the product chamber to reduce the temperature of obstacle surfaces. These compensation methods make the process less efficient in terms of time, material and energy.

Accordingly, a need has arisen for a new and improved method of reducing the melting of such ice crystals during their movement from the condensing chamber to the surfaces of the products in the freeze dryer. The method of the present invention meets this need.

BRIEF SUMMARY OF THE INVENTION

In order to improve the process efficiency, the new and improved method of the present invention uses $CO_2$ as a buffering agent in addition to the typical seeding. $CO_2$ has a boiling point at −70.6° F. (−57° C.) and melting point at −108.4° F. (−78° C.). When $CO_2$ gas is introduced into the condensing chamber before the seeding process, it will be condensed on the −60° C. to −85° C. condensing surface in form of liquid or dry ice. A thin film of dry ice is deposited on the condensing surface to form a base layer on which the ice crystals grow into a frost layer. Using a low pressure improves the uniformity of the deposited layer. The dry ice thin film layer helps the frost layer break loose completely during pressure distribution to improve the ice seeding yield from frost build up.

During the seeding process, mixing in a small amount of $CO_2$ gas will imbed some dry ice crystals within the ice frost layer. When the pressure is released and the crystals break loose for seeding distribution, the flow will include both ice crystals and dry ice crystals. On contact with warmer objects, or during gas flow, the dry ice will melt and vaporize to absorb heat and generate extra cold gas flow which effectively reduces the loss of ice crystals by keeping the ice frozen and increasing the transfer rate. When a combined crystal (ice and dry ice) contacts a warm surface the $CO_2$ changes state to absorb energy, thus keeping the ice crystal frozen. In addition, the vaporization of the $CO_2$ produces additional gas flow to increase the velocity of the ice crystals, enabling them to reach their target faster. In essence, therefore, the $CO_2$ change of state from solid to gas is a micro-refrigeration effect and a gas expansion effect that enables the ice crystals to reach their target more efficiently.

DETAILED DESCRIPTION OF THE INVENTION

Figure 1:
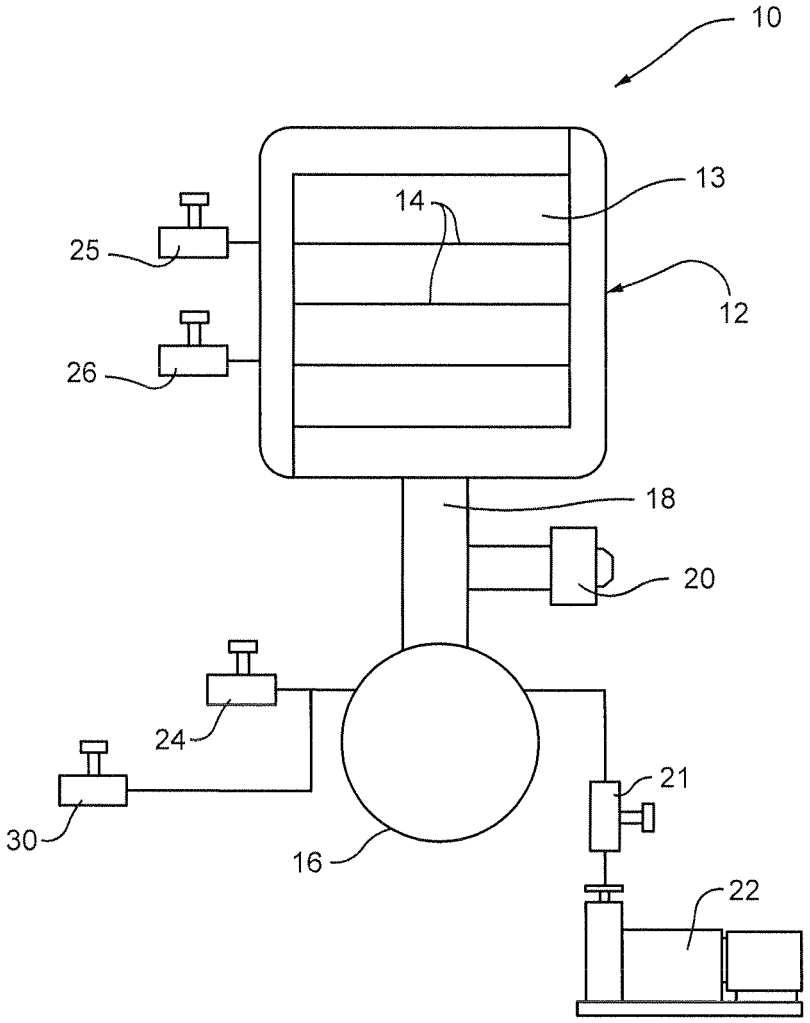
FIG. 1 is a schematic view of one embodiment of apparatus for performing the method of the present invention

As shown in FIG. 1, an apparatus 10 for performing the method of the present invention comprises a freeze dryer 12 having one or more shelves 14 for supporting vials of product to be freeze dried. A condenser chamber 16 is connected to the freeze dryer 12 by a vapor port 18 having an isolation valve 20 of any suitable construction between the condenser chamber 16 and the freeze dryer 12. Preferably, the isolation valve 20 is constructed to seal vacuum both ways.

A vacuum pump 22 is connected to the condenser chamber 16 with a valve 21 therebetween of any suitable construction. The condenser chamber 16 has a release valve 24 of any suitable construction and the freeze dryer 12 has a control valve 25 and release valve 26 of any suitable construction.

As an illustrative example, the operation of the apparatus 10 in accordance with one embodiment of the method of the present invention is as follows:

1. Cool down the shelf or shelves 14 to a pre-selected temperature (for example −5° C.) for nucleation below freezing point of water enough to super cool the product.

2. Hold the shelf temperature until all of the product probe temperatures are getting very close to the shelf temperature (for example within 0.5° C.).

3. Hold another 10 to 20 minutes for better temperature uniformity across all vials (not shown).

4. With the isolation valve 20 open, open the valve 21 and turn on the vacuum pump 22 to pump down the pressure of the chamber 13 in the freeze dryer 12 and the condenser chamber 16 to a low point which is still above the vapor pressure of water at the product temperature to prevent any bubble formation. (for example 50 Torr)

5. Close the isolation valve 20 between the product chamber 13 and condenser chamber 16, and close the valve 21.

6. Verify condenser temperature is already at its max low usually −60° C. to −85° C.

7. Open the valve 30 which is connected to a source of $CO_2$ gas into the condenser chamber 16 at a low pressure, e.g., 50 Torr, to form a condensed frost layer of liquid and solid (dry ice) $CO_2$ on the inner surface of the condensing chamber on which ice crystals can be formed.

8. Close the valve 30 and open the valve 24 which is connected to a water vapor and $CO_2$ gas source to slowly fill the condenser chamber 16 with the water vapor and $CO_2$ gas mixture up to a predetermined pressure to form a condensed frost layer of ice and dry ice crystals of a desired thickness on the condensed frost $CO_2$ layer on the inner surface of the condenser chamber.

9. Close the valve 24 on the condenser chamber 16.

10. Open the isolation valve 20 between the product chamber 13 (at low pressure) and the condenser chamber 16 (at a higher pressure with condensed frost on the inner surface thereof).

a. The sudden change of pressure creates strong gas turbulence in the condenser chamber which serves to vaporize the dry ice and efficiently separate the loosely condensed frost and ice/dry ice crystals from the inner surface of the condenser and break them into relatively large crystals that mix in the gas flow rushing into the product chamber to increase the effectiveness of the nucleation process in the product chamber. The ice/dry ice crystals are rapidly injected into the product chamber 13 where they are distributed evenly across the chamber and into all of the product to be freeze dried. The ice crystals serve as nucleation sites for the ice crystals to grow in the sub-cooled solution. With the even distribution, all of the product nucleates within a short period of time. The nucleation process of the product will start from top down and finish within a few seconds.

b. During the transfer of the ice/dry ice crystals into the product chamber, the vaporization of dry ice absorbs any heat being introduced along the transfer path and produces additional gas flow to increase the velocity of the ice/dry ice crystals to keep them frozen longer and move them faster to the product to be freeze dried.

Accordingly, the triple improvements of better ice seeding yield, less melting loss and higher distribution flow velocity all contribute to greater controlled ice nucleation efficiency. The amount of $CO_2$ introduced during the seeding process should be less than the pH level of product in solution. Any residual $CO_2$ gas is effectively re-condensed on the condensing surface during a subsequent freezing process or is removed when a vacuum is applied to the system, thus leaving no residual effect on the product.

In accordance with a second embodiment of the method of the present invention, the step of introducing $CO_2$ gas into the condenser chamber to form a condensed frost layer of dry ice on the inner surface of the condenser chamber prior to the introduction of the water vapor and $CO_2$ gas mixture may be omitted. In this embodiment, the condensed frost layer of ice and dry ice crystals, therefore, is formed directly on the inner surface of the condenser chamber.

Figure 2:
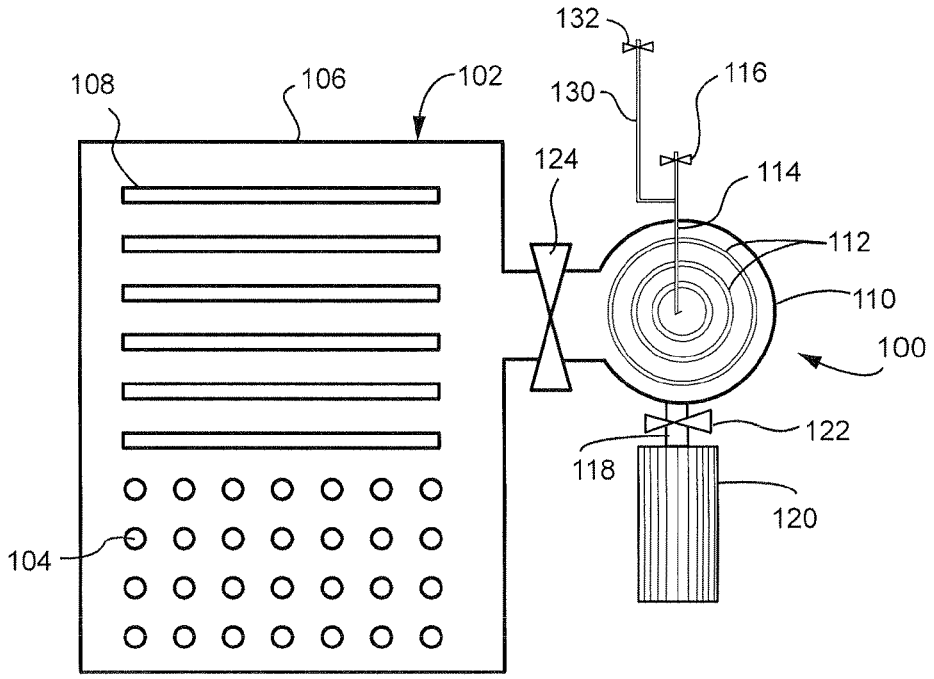
FIG. 2 is a schematic view of a second embodiment of apparatus for performing the method of the present invention connected to a freeze dryer with an internal condenser.

FIG. 2 illustrates a compact condenser 100 connected to a freeze dryer 102 having an internal condenser 104 which is not constructed to produce condensed frost therein and requires an additional seeding chamber and related hardware to be added. The freeze dryer 102 comprises a product chamber 106 with shelves 108 therein for supporting the product to be freeze dried.

The compact condenser 100 comprises a nucleation seeding generation chamber 110 having a cold surface or surfaces 112 defining frost condensing surfaces. The cold surface 112 may be a coil, plate, wall or any suitable shape to provide a large amount of frost condensing surface in the nucleation seeding generation chamber 110 of the compact condenser 100. A moisture injection nozzle 114 extends into the nucleation seeding generation chamber 110 and is provided with a moisture injection valve 116. A $CO_2$ gas supply line 118 having a filter 120 is connected to the nucleation seeding generation chamber 110 by vacuum release valve 122. The nucleation seeding generation chamber 110 of the compact condenser 100 is connected to the freeze dryer 102 by a nucleation valve 124. A second $CO_2$ gas supply line 130 with a valve 132 may be connected to the moisture injection nozzle 114.

Figure 3:
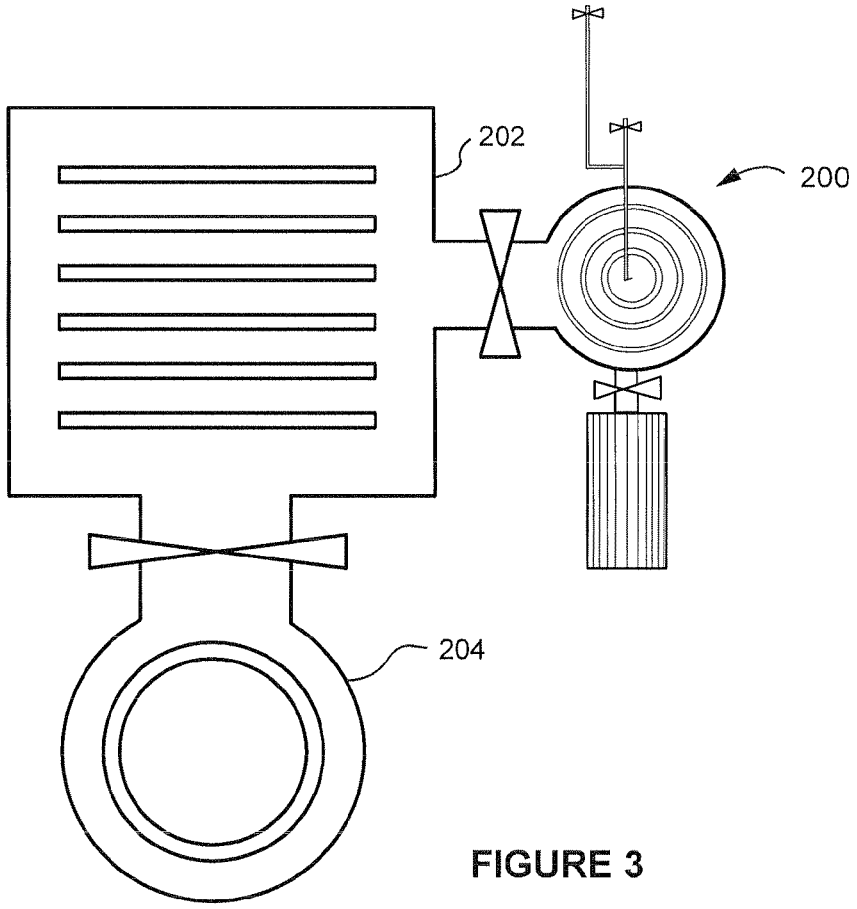
FIG. 3 is a schematic view of the second embodiment of the apparatus for performing the method of the present invention connected to a freeze dryer having an external condenser.

FIG. 3 illustrates a compact condenser 200 connected to a freeze dryer 202 having an external condenser 204. The construction and operation of the compact condenser 200 is the same as that of the compact condenser 100 shown in FIG. 2.

From the foregoing description, it will be readily seen that the novel method of the present invention produces condensed ice/dry ice frost and crystals in a condenser chamber external to the product chamber in a freeze dryer and then, as a result of gas turbulence, rapidly introduces the ice crystals with minimal melting into the product chamber which is at a pressure much lower than the pressure in the condenser chamber. This method produces rapid and uniform nucleation of the product in all areas of the freeze dryer.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of controlling and enhancing the nucleation of product in a freeze dryer, comprising:

maintaining the product at a predetermined temperature and pressure in a chamber of the freeze dryer;

introducing a mixture of water vapor and $CO_2$ gas into a condenser chamber separate from the product chamber to create a predetermined volume of condensed frost, ice and dry ice crystals on an inner surface of the condenser chamber, the condenser chamber being connected to the product chamber by a vapor port and having a predetermined pressure that is greater than that of the product chamber; and opening the vapor port into the product chamber to create gas turbulence that causes the condensed frost in the form of an ice fog and accompanying ice and dry ice crystals to rapidly enter the product chamber for even distribution therein to create uniform and rapid nucleation of the product in different areas of the product chamber.

2. The method of claim 1, wherein the pressure within the product chamber is about 50 Torr and the pressure within the condenser chamber is about 760 Torr when the vapor port is opened into the product chamber.

3. The method of claim 2, wherein the temperature of the product chamber is about −5° C. and the temperature of the condenser chamber is about −60° C. to −85° C. when the vapor port is opened into the product chamber.

4. The method of claim 1, wherein upon contact with warmer objects during travel of the ice and dry ice crystals from the condenser chamber to the product chamber, some of the dry ice will melt and vaporize to absorb heat and generate cold gas flow to reduce the loss of the ice crystals by keeping the ice frozen and increasing the rate of travel of the ice crystals into the product chamber.

5. A method of controlling and enhancing the nucleation of product in a freeze dryer, comprising:

maintaining the product at a predetermined temperature and pressure in a chamber of the freeze dryer;

introducing a mixture of water vapor and $CO_2$ gas into a condenser chamber separate from the product chamber to create a predetermined volume of condensed frost, ice and dry ice crystals on an inner surface of the condenser chamber, the condenser chamber being connected to the product chamber by a vapor port and having a predetermined pressure that is greater than that of the product chamber; and opening the vapor port into the product chamber to create gas turbulence that causes the condensed frost in the form of an ice fog and accompanying ice and dry ice crystals to rapidly enter the product chamber for even distribution therein to create uniform and rapid nucleation of the product in different areas of the product chamber;

wherein $CO_2$ gas is introduced into the condenser chamber prior to the introduction of the water vapor and $CO_2$ gas mixture to create a dry ice layer of predetermined thickness on the inner surface of the condenser chamber to facilitate the formation of the condensed frost, ice and dry ice crystals thereon and their removal when the vapor port is opened.

* * * * *